United States Patent [19]

Akimura et al.

[11] Patent Number: 4,520,099

[45] Date of Patent: May 28, 1985

[54] SILVER HALIDE PHOTOGRAPHIC LIGHT-SENSITIVE MATERIALS

[75] Inventors: Yoshitaka Akimura; Hiroyuki Mifune; Koki Nakamura, all of Kanagawa, Japan

[73] Assignee: Fuji Photo Film Co., Ltd., Kanagawa, Japan

[21] Appl. No.: 528,928

[22] Filed: Sep. 2, 1983

[30] Foreign Application Priority Data

Sep. 2, 1982 [JP] Japan ..... 57-152913

[51] Int. Cl.[3] ..... G03C 1/34

[52] U.S. Cl. ..... 430/613

[58] Field of Search ..... 430/613, 551, 448, 607, 430/490

[56] References Cited

U.S. PATENT DOCUMENTS 2,691,588 10/1954 Henn et al. ..... 430/490

3,193,386 7/1965 White ..... 430/607

*Primary Examiner*—Won H. Louie

*Attorney, Agent, or Firm*—Sughrue, Mion, Zinn, Macpeak & Seas

[57] ABSTRACT

A silver halide photographic light-sensitive material is disclosed. The material is comprised of a support having positioned thereon a silver halide emulsion layer and a compound represented by the general formula (I):

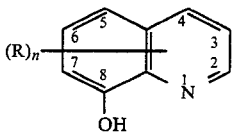

(I)

wherein R is a halogen atom or an alkyl group and n is 1, 2 or 3 and when n is 2 or 3 each R may be the same or different. Utilization of the compound represented by the general formula (I) aids in the elimination of the generation of fog without creating undesirable influences on the photographic properties of the material.

16 Claims, No Drawings

SILVER HALIDE PHOTOGRAPHIC LIGHT-SENSITIVE MATERIALS

FIELD OF THE INVENTION

The present invention relates to silver halide photographic light-sensitive materials and, particularly, to silver halide photographic light-sensitive materials in which aerial fog and spot fog are restrained.

BACKGROUND OF THE INVENTION

It has been well known that photographic emulsions are affected during preservation or by surrounding conditions in case of development to form a detectable amount of metal silver called fog on unexposed parts. Generation of the fog is accelerated not only under bad conditions during preservation but also under bad conditions during development. When they are exposed to air in a state of wetting with a developing solution in case of development, the fog is particularly vigorously generated, which is generally called "aerial fog".

With respect to the fog, a presumptive mechanism of generation of the fog and acceleration of aerial fog in the presence of copper or iron have been described in "Stabilization of Photographic Silver Halide Emulsions", written by E. J. Birr, published by Focal Press, 1974, pages 128–129, and, further, a method restraining the fog has been described therein.

In order to prevent such aerial fog, it has been proposed to use amide and oxime compounds described in British Pat. Nos. 988,052, 623,448 and 1,057,470 (corresponding to U.S. Pat. No. 3,393,072) cited in the above described literature. However, many of these compounds are not satisfactory, because their effect is poor or the effect remarkably deteriorates after preservation of the light-sensitive materials at a high temperature and a high humidity, even if it is excellent at first. Alternatively, they cause side reactions with a hardener in the gelatin film to result in bad influences such as deterioration of quality of the gelatin film.

It has been described in U.S. Pat. No. 3,193,386 that safety with respect to a safe light is improved and black spot fog can be prevented by using 8-hydroxyquinoline which resembles the compound of the present invention together with 8-hydroxyquinoline-5-sulfonic acid. However, the effect is insufficient, even though 8-hydroxyquinoline has some ability to prevent aerial fog by itself as shown in the example.

Accordingly, it has been desired to use aerial antifogging agents which do not have the bad effects and are effective for a long period of time. Further, in recent years, it has been desired to use antifogging agents which have stronger effects, because high temperature development or quick development is often carried out which increases the degree of fog due to the faster processing.

SUMMARY OF THE INVENTION

The present inventors have found that, when a compound represented by the following general formula (I) is added to a silver halide emulsion layer or a light-insensitive colloid layer (for example, a protective layer or an intermediate layer, etc.), generation of aerial fog is remarkably restrained and this restraining is obtained without undesirable influences even if preserved at a high temperature under a high humidity.

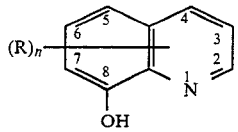

(I)

In the formula, R represents a halogen atom (for example, a chlorine atom, a bromine atom or an iodine atom, etc.) or an alkyl group (preferably, that having 1 to 8 carbon atoms, for example, a methyl group, an ethyl group or a propyl group, etc.). Preferably, R represents a halogen atom.

n represents 1, 2 or 3, and preferably 1 or 2. Further, when n represents 2 or 3, each R may be same or different.

Further, by addition of the compound of the present invention, generation of spot fog (for example, black spot fog) caused by the base, gelatin, chemicals added or contamination with a fine metal powder (for example, iron powder, etc.) in the step of production or processing can be simultaneously prevented without undesirable influences. Further, use of to compound (I) does not create other undesirable influence such as deterioration of the quality of the gelatin film caused by side reactions with the hardener.

DETAILED DESCRIPTION OF THE INVENTION

Examples of the compound represented by the general formula (I) are illustrated.

1. 5,7-Dichloro-8-hydroxyquinoline.
2. 5,7-Dibromo-8-hydroxyquinoline.
3. 5-Chloro-7-iodo-8-hydroxyquinoline.
4. 5-Chloro-8-hydroxyquinoline.
5. 5-Chloro-7-bromo-8-hydroxyquinoline.
6. 2-Methyl-8-hydroxyquinoline.
7. 4-Ethyl-8-hydroxyquinoline.
8. 5-Methyl-8-hydroxyquinoline.
9. 2-Methyl-5-chloro-8-hydroxyquinoline.

Preferred examples of the compound represented by the general formula (I) are Compounds 1, 2, 3, 4, 5 and 9.

The compounds represented by the general formula (I) are generally commercially available, or they can be easily synthesized by persons skilled in the art according to the process described in "Beilstein" vol. 21, pages 95, 97 and 222, etc. if they are not available in the market.

Compounds 1 to 5 can be synthesized on the basis of the description of the above described "Beilstein", and other compounds can be easily synthesized by a reaction of 2-aminophenol or 2-amino-4-alkylphenol with crotonaldehyde or vinyl alkyl ketone, a reaction of alkyl substituted 8-hydroxyquinoline with sulfuryl chloride or a reaction of 2-amino-4-halogenophenol with crotonaldehyde or vinyl alkyl ketone according to the above described process.

The amount of the compound represented by the general formula (I) of the present invention to be added to the hydrophilic colloid layer is not particularly restricted, but it is preferred to be 0.1 to 120 g, more preferably 1 to 60 g, based on 1 kg of gelatin in the layer.

The compounds represented by the general formula (I) of the present invention are added to, for example, the hydrophilic colloid layer such as a silver halide emulsion layer, an antihalation layer, an intermediate layer, a subbing layer, a protective layer, etc. Further, the compounds can be added to a backing layer simultaneously with added to the above-described hydrophilic colloid layer.

In the silver halide photographic light-sensitive materials of the present invention, silver in an amount of 1 to 50 mols based on 1 kg of gelatin is generally contained.

In photographic emulsion layers of the photographic light-sensitive materials of the present invention, any of silver bromide, silver iodobromide, silver iodochlorobromide, silver chlorobromide and silver chloride may be used as silver halide.

The average particle size (the diameter in case of spherical particles or the like and the side length in case of cubic particles are regarded as particle size, which are represented as an average based on projected area) of silver halide particles in the photographic emulsions is not restricted, but it is preferably 3$\mu$ or less.

The distribution of particle size may be either wide or narrow.

The silver halide particles in the photographic emulsions may have any crystal form, for example, a regular crystal form such as cube or octahedron, or an irregular crystal form such as sphere or plate, etc., or a crystal form which is a composite of them. They may be a mixture of particles having various crystal forms.

The silver halide particles may have a structure wherein the inner part and the surface layer are each composed of a different phase, or they may be composed of a homogeneous phase. They may be either particles in which latent images are chiefly formed on the surface thereof or particles in which the latent images are chiefly formed in the inner part thereof.

The photographic emulsions used in the present invention can be prepared by processes described in P. Glafkides: Chemie et Physique Photographique (published by Paul Montel Co., 1967), G. F., Duffin: Photographic Emulsion Chemistry (published by The Focal Press, 1966) and V. L. Zelikman et al: Making and Coating Photographic Emulsion (published by The Focal Press, 1964), etc. Namely, any of acid process, neutral process and ammonia process may be used. Further, as a manner of reacting soluble silver salts with soluble halogen salts, any of single jet process, double jet process and a combination thereof may be used.

A process of forming particles in the presence of excess of silver ions (the so-called reversal mixing process) can also be used. A useful double jet process is process in which the pAg of the liquid phase where silver halide is formed is kept at a constant value, namely, the so-called controlled double jet process.

According to this process, silver halide emulsions having a regular crystal form and a uniform particle size are obtained.

Two or more silver halide emulsions prepared respectively may be mixed to use.

Cadmium salts, zinc salts, lead salts, thallium salts, iridium salts or complex salts thereof, rhodium salts or complex salts thereof, or iron salts or complex salts thereof, etc. may be present in the stage of formation of silver halide particles or physical ageing. Particularly, rhodium salts and iridium salts are preferred.

The silver halide emulsions may be chemically sensitized. When carrying out chemical sensitization, it is possible to use a sulfur sensitization process using sulfur containing compounds capable of reacting with active gelatin or silver (for example, thiosulfates, thioureas, mercapto compounds and rhodanines), a reduction sensitization process using reductive substances (for example, stannous salts, amines, hydrazine derivatives, formamidinesulfinic acid and silane compounds) and a noble metal sensitization process using noble metal compounds (for example, gold complex salts and complex salts of metals of group VIII in the periodic table such as Pt, Ir or Pd, etc.), which are used alone or as a combination thereof.

Examples of the sulfur sensitization processes have been described in U.S. Pat. Nos. 1,574,944, 2,410,689, 2,278,947, 2,728,668 and 3,656,955, etc., reduction sensitization processes have been described in U.S. Pat. Nos. 2,983,609, 2,419,974 and 4,054,458, etc. and the noble metal sensitization processes have been described in U.S. Pat. Nos. 2,399,083 and 2,448,060 and British Pat. No. 618,061, etc.

As a binder or protective colloid of the photographic emulsions, gelatin is advantageously used, but other hydrophilic colloids can be used.

For example, it is possible to use proteins such as gelatin derivatives, graft polymer of gelatin with other high polymers, albumin or casein, etc., saccharose derivatives such as cellulose derivatives such as hydroxyethyl cellulose, carboxymethyl cellulose or cellulose sulfate, etc., sodium alginate or starch derivatives, etc., and various synthetic hydrophilic high molecular substances such as homopolymers or copolymers, for example, polyvinyl alcohol, polyvinyl alcohol partial acetal, poly-N-vinylpyrrolidone, polyacrylic acid, polymethacrylic acid, polyacrylamide, polyvinylimidazole and polyvinylpyrazole, etc.

The photographic emulsions used in the present invention may be spectrally sensitized with methine dyes or the like. These sensitizing dyes may be used alone, but combinations of them can be used. Combinations of sensitizing dyes are frequently used, particularly for supersensitization. The emulsions may contain, in addition to the sensitizating dyes, dyes which do not have a spectral sensitization function themselves or substances which do not substantially absorb visible light but cause supersensitization.

Available sensitizing dyes, combinations of dyes causing supersensitization and substances causing supersensitization have been described in Research Disclosure vol. 176, 17643 (published in December 1978) page 23, IV—paragraph J.

The photographic emulsions used in the present invention can contain various compounds for the purpose of preventing generation of fog in the step of producing the light-sensitive materials, during preservation or photographic processing thereof or for the purpose of stabilizing photographic properties. Namely, it is possible to add various compounds known as antifogging agents or stabilizers, for example, azoles such as benzothiazolium salts, nitroinidazoles, nitrobenzimidazoles, chlorobenzimidazoles, bromobenzimidazoles, mercaptothiazoles, mercaptobenzothiazoles, mercaptobenzimidazoles, mercaptothiazoles, aminotriazoles, benzotriazoles, nitrobenzotriazoles or mercaptotetrazoles (particularly, 1-phenyl-5-mercaptotetrazole), etc., mercaptopyrimidines, mercaptotriazines, thioketo compounds such as oxazolinethione, azaindenes such as triazaindenes, tetraazaindenes (particularly, 4-hydroxy-substituted (1,3,3a,7)tetraazaindenes) or pentaazaindenes, etc., benzenethiosulfonic acid, benzenesulfinic acid and benzenesulfonic acid amide, etc. For example, materials described in U.S. Pat. Nos. 3,954,474 and 3,982,947 and Japanese Patent Publication No. 28660/77 can be used.

In the photographic light-sensitive materials of the present invention, the photographic emulsion layers and other hydrophilic colloid layers may contain inorganic or organic hardening agents. For example, it is possible to use chromium salts (chromium alum and chromium acetate, etc.), aldehydes (formaldehydes, glyoxal and glutaraldehyde, etc.), N-methylol compounds (dimethylolurea and methyloldimethylhydantoin, etc.), dioxane derivatives (2,3-dihydroxydioxane, etc.), active vinyl compounds (1,3,5-triacryloylhexahydro-s-triazine and 1,3-vinylsulfonyl-2-propanol, etc.), active halogen compounds (2,4-dichloro-6-hydroxy-s-triazine, etc.) and mucohalogenic acids (mucochloric acid and mucophenoxychloric acid, etc.), which can be used alone or as a combination of them.

The photographic emulsion layers in the photographic light-sensitive materials of the present invention may contain, for example, polyalkylene oxide or derivatives thereof, such as ethers, esters or amines, etc., thioether compounds, thiomorpholines, quaternary ammonium compounds, urethane derivatives, urea derivatives, imidazole derivatives and 3-pyrazolidones, etc. for the purpose of increasing sensitivity, increasing contrast or accelerating development.

The photographic emulsion layer and other hydrophilic colloid layers in the photographic light-sensitive materials of the present invention may contain a dispersion of water insoluble or poorly-soluble synthetic polymers for the purpose of improving dimensional stability. For example, it is possible to use polymers composed of one or more monomers selected from alkyl acrylate, alkyl methacrylate, alkoxyalkyl acrylate, alkoxyalkyl methacrylate, glycidyl acrylate, glycidyl methacrylate, acrylamide, methacrylamide, vinyl ester (for example, vinyl acetate), acrylonitrile, olefin and styrene, etc. and polymers composed of the above described monomers and monomers selected from acrylic acid, methacrylic acid, $\alpha,\beta$-unsaturated dicarboxylic acid, hydroxyalkyl acrylate, hydroxyalkyl methacrylate, sulfoalkyl acrylate, sulfoalkyl methacrylate, and styrenesulfonic acid, etc. For example, it is possible to use those described in U.S. Pat. Nos. 2,376,005, 2,739,137, 2,853,457, 3,062,674, 3,411,911, 3,488,708, 3,525,620, 3,607,290, 3,635,715 and 3,645,740 and British Pat. Nos. 1,186,699 and 1,307,373.

The photographic emulsions layers in the photographic light-sensitive materials of the present invention may contain color forming couplers, namely, compounds capable of coloring by oxidative coupling with aromatic primary amine developing agents (for example, phenylenediamine derivatives or aminophenol derivatives, etc.) in color development processing. Examples of useful magenta couplers include 5-pyrazolone couplers, pyrazolobenzimidazole couplers, cyanoacetylcoumarone couplers and ring-opened acylacetonitrile couplers, etc. Examples of useful yellow couplers include acylacetamide couplers (for example, benzoylacetanilides and pivaloylacetanilides, etc.), etc. Examples of useful cyan couplers include naphthol couplers and phenol couplers, etc.

Addition of the couplers to the silver halide emulsion layers is carried out by known methods, for example, a method described in U.S. Pat. No. 2,322,027, etc.

To the silver halide photographic light-sensitive materials of the present invention, it is possible to add, as occasion demands, mordants such as cationic polymers, etc., anti-color-fogging agents such as hydroquinone derivatives or aminophenol derivatives, etc., ultraviolet ray absorbing agents such as benzotriazole compounds substituted by an aryl group, etc., dyes such as oxonol compounds or hemioxonol compounds, etc., antifading agents such as p-alkoxyphenols or hydroquinone derivatives, etc., and surface active agents such as saponin (steroid type), polyethylene glycol or polyethylene glycol esters, etc. These compounds have been described in detail in Research Disclosure, Vol. 176, 17643 (published in December 1978).

In the photographic light-sensitive materials of the present invention, the photographic emulsion layers and the other layers are applied to flexible bases conventionally used for photographic light-sensitive materials, such as plastic films, paper or cloth, etc. or rigid bases such as glass, porcelain or metal, etc. Examples of available flexible bases include films composed of semisynthetic or synthetic high polymers such as cellulose nitrate, cellulose acetate, cellulose acetate butyrate, polystyrene, polyvinyl chloride, polyethylene terephthalate, or polycarbonate, etc., and papers coated or laminated with a barita layer of $\alpha$-olefin polymer (for example, polyethylene, polypropylene or ethylene-butene copolymer), etc.

The compound represented by the general formula (I) of the present invention can be used not only for black-and-white photographic light-sensitive materials such as black-and-white printing papers, lithographic light-sensitive materials or X-ray sensitive materials, etc., but also for color photographic light-sensitive materials such as color negative light-sensitive materials, color reversal light-sensitive materials or color papers, etc.

When carrying out photographic processing of the light-sensitive materials of the present invention, it is possible to apply known methods and known processing solutions as described in, for example, Research Disclosure, Vol. 176, pages 28–30 (RD-17643). This photographic processing may be any of photographic processing for forming silver images (black-and-white photographic processing) and photographic processing for forming dye images (color photographic processing) as occasion demands. The processing temperature is generally selected from a range of 18° C. to 50° C., but a temperature lower than 18° C. or a temperature higher than 50° C. may be used.

The developing solution used when carrying out black-and-white photographic processing can contain known developing agents. Useful developing agents include dihydroxybenzenes (for example, hydroquinone), 3-pyrazolidones (for example, 1-phenyl-3-pyrazolidone), and aminophenols (for example, N-methyl-p-aminophenol), which can be used alone or as a combination thereof.

The so-called "litho-type" development processing can be applied to the photographic emulsions of the present invention. The "litho type" development processing means development processing in which the development stage is infectiously carried out using dihydroxybenzenes as a developing agent in a low sulfurous acid ion concentration in order to carry out photographic reproduction of linear images or photographic reproduction of halftone images by a mesh screen. (Details are described in Mason: "Photographic Processing Chemistry" (1966) pages 163–165).

As a specific type of development processing, the development may be carried out by a process wherein a light-sensitive material containing a developing agent in, for example, an emulsion layer is treated with an aqueous solution of alkali.

A conventional fixing solution composition can be used. Useful fixing agents include not only thiosulfates and thiocyanates but organic sulfur compounds which are known to have an effect as a fixing agent. The fixing solution may contain water soluble aluminium salts as hardeners.

Conventional processes for forming dye images can be utilized such as a negative-positive process (for example, described in "Journal of the Society of Motion Picture and Television Engineers", vol. 61 (1953) pages 667–701, a color reversal process which comprises developing with a developing solution containing a black-and-white developing agent to form negative silver images, uniformly exposing to light at least one time or carrying out another suitable fogging treatment, and thereafter carrying out color development to obtain dye positive images, and a silver dye bleaching process which comprises developing the photographic emulsion layers containing dyes to form silver images after exposing to light, and bleaching the dyes using the silver images as a bleaching catalyst.

The color developing solution generally consists of an alkaline aqueous solution containing a color developing agents useful color developing agent include known primary aromatic amine developing agents such as phenylenediamines (for example, 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline and 4-amino-3-methyl-N-ethyl-N-β-methoxyethylaniline, etc.).

Furthermore, materials described in L. F. Mason: Photographic Processing Chemistry (published by Focal Press, 1966) pages 226–229, U.S. Pat. Nos. 2,193,015 and 2,592,364 and Japanese Patent Application (OPI) 64933/73, etc. may be used.

The developing solution may additionally contain pH buffer agents, development restrainers or antifogging agents, etc. Further, it may contain, if necessary, water softeners, preservatives, organic solvents, development accelerators, dye forming couplers, competitive couplers, fogging agents, auxiliary developing agents, thickening agents, polycarboxylic acid type chelating agents, antioxidants, hardeners, alkali agents, toning agents, surface active agents and defoaming agents, etc.

The invention will now be described in terms of specific examples. However, the scope of the invention is not limited to these examples.

EXAMPLE 1

A silver chloroiodobromide emulsion (average particle size: 0.3μ, chlorine: 80% by mol, iodine: 0.1% by mol) chemically sensitized with sodium thiosulfate and potassium chloroaurate was divided into 17 equal parts. After 3-carboxymethyl-5-[2-(3-ethyl-2-(3H)-thiazolinylideneethylidene]rhodanine, 4-hydroxy-6-methyl-1,3,3a,7-tetraazaindene and polyethylene oxide phenyl ether (average molecular weight: 2000) were added to each of them, the compound of the present invention or a comparative compound was added thereto as shown in Table 1, and further a dispersion of polyethyl acrylate, 2,4-dichloro-6-hydroxy-1,3,5-triazine sodium salt, sodium p-dodecylbenzenesulfonate and sodium p-nonylphenoxy-poly(ethyleneoxy)propanesulfonate were added in order. Thereafter, they were applied to film bases and dried.

For the purpose of increasing generation of the aerial fog, the following development processing was carried out. The photographic films were immersed in a developing solution at 27° C. for 40 seconds and they were then exposed to air for 30 seconds at a room temperature and, thereafter, immersed again in the developing solution at 27° C. for 30 seconds. The developing solution used was that which was prepared by adding 0.1 ppm of cupric bromide to a lithographic developing solution having the following composition so as to increase generation of the aerial fog. (Lithographic developing solution)

| | |
|---|---|
| Hydroquinone | 15 g |
| Addition product of formaldehyde and sodium bisulfite | 50 g |
| Potassium carbonate | 30 g |
| Sodium sulfite | 2.5 g |
| Potassium bromide | 2.0 g |
| Boric acid | 5.0 g |
| Sodium hydroxide | 3.0 g |
| Triethylene glycol | 40 g |
| EDTA.2Na | 1.0 g |
| Diethanolamine | 15 g |
| Water | to make 1000 ml |

Samples just after application and those preserved at 40° C. under 65% RH for 20 days were processed as described above.

As shown in Table 1, the compounds of the present invention remarkably prevent generation of aerial fog and the effect thereof does not change even after samples were preserved at a high temperature under a high humidity.

On the contrary, comparative compounds (a) (b) and (c) do not prevent generation of aerial fog if not added in a comparatively large amount, and the effect thereof remarkably deteriorates after the samples were preserved at a high temperature under a high humidity.

TABLE 1

| | Compound | (amount added g/kg gelatin) | Fog density just after application | Fog density after preserved at 40° C. and 65% RH for 20 days |
|---|---|---|---|---|
| 1 | | — | 1.15 | 1.10 |
| 2 | Compound 1 | 2 g | 0.04 | 0.04 |
| 3 | Compound 1 | 10 g | 0.03 | 0.03 |
| 4 | Compound 2 | 2 g | 0.03 | 0.03 |
| 5 | Compound 2 | 10 g | 0.03 | 0.03 |
| 6 | Compound 3 | 4 g | 0.03 | 0.03 |
| 7 | Compound 4 | 4 g | 0.04 | 0.04 |
| 8 | Compound 4 | 12 g | 0.03 | 0.03 |
| 9 | Compound 5 | 4 g | 0.03 | 0.03 |
| 10 | Compound 6 | 10 g | 0.04 | 0.08 |
| 11 | Compound 9 | 10 g | 0.03 | 0.03 |
| 12 | Comparative compound (a) | 4 g | 0.06 | 0.25 |
| 13 | Comparative compound (a) | 12 g | 0.03 | 0.15 |
| 14 | Comparative compound (b) | 12 g | 0.10 | 1.05 |
| 15 | Comparative compound (a) + (b) | 12 g + 12 g | 0.03 | 0.15 |
| 16 | Comparative compound (c) | 12 g | 0.08 | 0.18 |

Comparative compound (a)

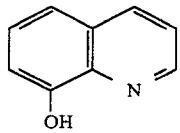

(b)

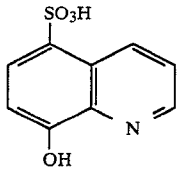

(c)

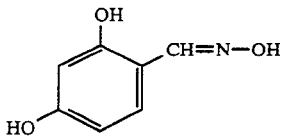

Further, when the compounds 1, 2, 3, 5, 6 and 9 were added to the gelatin protective layer, a remarkable effect of preventing aerial fog was observed as with the cases shown in Table 1.

EXAMPLE 2

A silver iodobromide emulsion (average particle size: 0.6μ, iodine: 5% by mol) chemically sensitized with sodium thiosulfate and potassium chloroaurate was divided into 5 equal parts. After 5,5'-dichloro-9-ethyl-3,3'-di-(3-sulfopropyl)oxacarbocyanine sodium salt, and 4-hydroxy-6-methyl-1,3,3a,7-tetraazaindene were added to each of them, the compound of the present invention or the comparative compound was added thereto as shown in Table 2, and further 2,4-dichloro-6-hydroxy-1,3,5-triazine sodium salt, sodium p-dodecylbenzenesulfonate and sodium p-nonylphenoxy-poly(ethyleneoxy)propanesulfonate were added in order. After a fine iron powder was added in an amount of 10 ppm based on silver, the mixtures were applied to film bases and dried. For comparison, mixtures which do not contain the compound shown in Table 2 and mixtures which do not contain both the compound shown in Table 2 and the iron powder were applied and dried similarly.

Samples produced as described above were subjected to development processing at 20° C. for 3 minutes using a developing solution having the following composition without exposing to light, and thereafter they were dried. The total number of developed spots was compared. The results are shown in Table 2. (Composition of the developing solution)

| | |
|---|---|
| Monomethyl-p-aminophenol sulfate | 3.1 g |
| Anhydrous sodium sulfite | 45 g |
| Hydroquinone | 12 g |
| Sodium carbonate 1 hydrate | 79 g |
| Potassium bromide | 1.9 g |
| Water | to make 3 liters |

TABLE 2

| Experiment No. | Compound | Amount g/kg gelatin | Presence or absence of iron powder | Number of spots number/100 m$^2$ |
|---|---|---|---|---|
| 21 | — | — | Absence | 0 |
| 22 | — | — | Presence | 60 |
| 23 | Compound 1 | 4 | Presence | 0 |
| 24 | Compound 2 | 4 | Presence | 0 |
| 25 | Compound 4 | 8 | Presence | 0 |
| 26 | Comparative compound (a) | 4 | Presence | 15 |
| 27 | Comparative compound (a) | 20 | Presence | 3 |
| 28 | Comparative compound (b) | 20 | Presence | 45 |

Table 2 clearly shows that though spots are remarkably formed when using the comparative compounds, generation of spots caused by the iron powder is remarkably restrained by addition of the compounds of the present invention.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material, comprising:

a support having positioned thereon;

a silver halide emulsion layer; and a compound represented by the general formula (I):

(I)

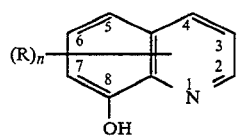

wherein R is a halogen atom or an alkyl group and an n is 1, 2 or 3 and when n is 2 or 3 each R may be the same or different, said compound is present in an amount sufficient to restrain fog.

2. A silver halide photographic light-sensitive material, as claimed in claim 1, wherein the compound represented by the general formula (I) is dispersed in a hydrophilic colloid layer comprised of a gelatin and wherein the silver halide emulsion layer is comprised of silver halide particles dispersed in a gelatin.

3. A silver halide photographic light-sensitive material, as claimed in claim 2, wherein the compound represented by the general formula (I) is present in an amount of 0.1 to 120 g per 1 kg of gelatin.

4. A silver halide photographic light-sensitive material, as claimed in claim 3, wherein the compound represented by the general formula (I) is present in an amount in the range of 1 to 50 g per 1 kg of gelatin.

5. A silver halide photographic light-sensitive material as claimed in claim 1, wherein the compound represented by the general formula (I) is a compound selected from the group consisting of:

5,7-Dichloro-8-hydroxyquinoline
5,7-Dibromo-8-hydroxyquinoline
5-Chloro-7-iodo-8-hydroxyquinoline
5-Chloro-8-hydroxyquinoline
5-Chloro-7-bromo-8-hydroxyquinoline
2-Methyl-8-hydroxyquinoline
4-Ethyl-8-hydroxyquinoline
5-Methyl-8-hydroxyquinoline 2-Methyl-5-chloro-8-hydroxyquinoline

6. A silver halide photographic light-sensitive material as claimed in claim 1, wherein in the compound represented by the general formula (I) at least one of R is a halogen atom.

7. A silver halide photographic light-sensitive material as claimed in claim 1, wherein the R is selected from the group consisting of a chlorine atom, a bromine atom, and an iodine atom.

8. A silver halide photographic light-sensitive material as claimed in claim 1, wherein within the formula (I) the R is an alkyl group containing 1 to 8 carbon atoms.

9. A silver halide photographic light-sensitive material as claimed in claim 1, wherein R is a halogen atom.

10. A silver halide photographic light-sensitive material as claimed in claim 9, wherein n is 1.

11. A silver halide photographic light-sensitive material as claimed in claim 9, wherein n is 2.

12. A silver halide photographic light-sensitive material as claimed in claim 9, wherein n is 3.

13. A silver halide photographic light-sensitive material as claimed in claim 1, wherein R is an alkyl group.

14. A silver halide photographic light-sensitive material as claimed in claim 13, wherein n is 1.

15. A silver halide photographic light-sensitive material as claimed in claim 13, wherein n is 2.

16. A silver halide photographic light-sensitive material as claimed in claim 13, wherein n is 3.

* * * * *